US006070350A

United States Patent [19]

Fantone et al.

[11] Patent Number: 6,070,350

[45] Date of Patent: Jun. 6, 2000

[54] DISPLAY/VIEWER FOR MULTIPLE, 3D, AND OTHER SPECIAL VISUAL EFFECTS

[75] Inventors: Stephen D. Fantone, Lynnfield, Mass.; Anthony L. Gelardi, Cape Porpoise; John A. Gelardi, Kennebunkport, both of Me.

[73] Assignee: Insight, Inc., Lynnfield, Mass.

[21] Appl. No.: 09/350,779

[22] Filed: Jul. 9, 1999

Related U.S. Application Data

[60] Provisional application No. 60/092,679, Jul. 13, 1998.

[51] Int. Cl.[7] ..... G09F 19/14

[52] U.S. Cl. ..... 40/454; 40/427; 40/765; 40/779

[58] Field of Search ..... 40/427, 453, 454, 40/705, 709, 765, 779, 611; 359/619, 626; 206/308.1

[56] References Cited

U.S. PATENT DOCUMENTS

| | | | |
|---|---|---|---|
| 231,473 | 8/1880 | Brower | 40/765 |
| 4,250,641 | 2/1981 | Thompson | 40/705 |
| 4,305,498 | 12/1981 | Paytas | 40/765 X |
| 4,750,282 | 6/1988 | Zennedjan | 40/611 X |
| 5,364,274 | 11/1994 | Sekiguchi | 40/436 X |
| 5,515,968 | 5/1996 | Taniyama | 206/308.1 X |
| 5,647,151 | 7/1997 | Fantone et al. | 40/427 X |
| 5,695,346 | 12/1997 | Sekiguchi et al. | 40/453 X |
| 5,710,666 | 1/1998 | McDonald | 359/463 |

*Primary Examiner*—Brian K. Green
*Attorney, Agent, or Firm*—Francis J. Caufield

[57] ABSTRACT

A display and viewing unit, for use with a printed insert card bearing at least one pair of interlaced images and having a reference edge, comprises a base bearing flexible fingers and a cover member having at least one transparent lenticulated section, a seating area for receiving the printed insert card, and an abutment against which the reference edge of the card can be placed. The base and the cover member pivot relative to one another between an open position and a closed position in which the flexible fingers lie adjacent the seating area, and in which the base and the cover member snap fit together to keep them in this closed position. Also, in this closed position, a slot is left between the base and the cover member so that the card can be inserted between them and viewed through the lenticulated section. The display permits cards to be readily inserted and removed.

7 Claims, 10 Drawing Sheets

DISPLAY/VIEWER FOR MULTIPLE, 3D, AND OTHER SPECIAL VISUAL EFFECTS

CROSS REFERENCE TO RELATED APPLICATIONS

This application claims priority from U.S. Provisional Patent Application Ser. No. 60/092,679 filed on Jul. 13, 1998. Attention is directed to commonly owned U.S. patent application Ser. No. 08/990,688, filed Dec. 15, 1997 and U.S. Ser. No. 60/074,384, filed Feb. 11, 1998, now U.S. patent application Ser. No. 09/211,510 filed on Dec. 14, 1998. These copending applications, the entire disclosures of which are herein incorporated by reference, describe methods for combining images which may be useful in preparing printed inserts for use in the displays/viewers of the present invention.

FIELD OF THE INVENTION

This invention relates generally to a display/viewer for displaying images and, more particularly, to optical and mechanical arrangements by which such a display/viewer can be conveniently configured to provide enhanced views of information such as graphics, photographs, alphanumeric data, and/or other symbolically coded information in a variety of different display modes. The display/viewer of this invention is especially designed to allow ready insertion and removal of images.

BACKGROUND OF THE INVENTION AND PRIOR ART

The use of frames for displaying images is a well-established practice. As is well-known, frames play a major role in the visual impact that an image can have; they isolate the important subject matter from its surroundings to focus the viewer's attention, aid in composition, and, if carefully chosen, can compliment the contents of an image.

Over the years, any number of materials have been used for frame construction including wood, ceramics, plastics, and metals. Configurations have included those that are adapted to hang from walls, sit on flat surfaces like an easel, or attach to metal surfaces via magnets. Use has also been made of plastic injection molding techniques to fabricate frames.

As visual communications continue to develop and proliferate at ever increasing rates, frames occupy an even greater role in the display of information than they ever had in the past. New technologies in image processing, acquisition, and generation continue to expand and drive the need for convenient and readily adaptable frame modalities that can used with a variety of image generation techniques, as well as the more traditional ones such as photography.

In addition, the number of images available and their use with other types of information such as alphanumeric data, or coded information, have created a need to be able to display as much visual information as possible per unit of display area. Consequently, the display of multiple images via the same display area has become an important requirement for display technology.

While optical approaches have been used in the past for direct magnification of content information about the insides of containers, none have provided more visual access to more information on the same viewable area or, more importantly, different information viewable through the same surface. For example, British Patent No. 2,222,143 entitled "BOX-LIKE CONTAINER" published on Feb. 28, 1990 discloses the use of a plano-convex, positive cylindrical lens arranged along the hinge edge of a tape cassette or compact disc box for purposes of providing magnification of informational matter carried directly behind it.

U.S. Pat. No. 4,863,026 entitled "STORAGE CASES FOR INFORMATION RECORDING DEVICES", issued on Sep. 5, 1989 discloses a Fresnel lens incorporated in or on the front cover panel of a case for purposes of magnifying information carried on the surface of a program card inserted in the case such that it lies directly beneath the lens.

In like manner, U.S. Pat. No. 4,044,889 entitled "COSMETIC CONTAINER INCLUDING INTEGRATED LENS STRUCTURE", issued on Aug. 30, 1977, also shows a Fresnel lens for magnifying tiny underlying information carried on the interior of a cosmetic container.

U.S. Pat. No. 4,863,026 entitled "STORAGE CASES FOR INFORMATION RECORDING DEVICES", issued in the name of Thomas J. Perkowski on Sep. 5, 1989, discloses a Fresnel lens arranged on the front cover of a magnetic tape, video tape, or compact disc storage box for magnifying information located directly behind the front cover at an appropriate distance.

Similarly, U.S. Pat. No. 4,044,889 entitled "COSMETIC CONTAINER INCLUDING INTEGRATED LENS STRUCTURE", issued to Seymour Orentreich et al. on Aug. 30, 1977, describes the use of Fresnel lens structures for magnifying information located on the interior surfaces of cosmetic containers.

U.S. Pat. No. 5,189,531 entitled "HOLOGRAM PRODUCTION", issued to Charles E. Palmer et al. on Feb. 23, 1993, describes techniques for forming holographic images in cosmetic compact covers or compact audio or video discs or the like.

Commonly-owned U.S. Pat. No. 5,647,151 entitled "MULTI-PURPOSE IMAGE DISPLAY SYSTEMS" issued to Stephen D. Fantone et al. on Jul. 15, 1997 (hereinafter for convenience called "Fantone"), describes an image display system for presenting multiple images to an observer by means of a transparent lenticulated section through which is viewed a printed insert bearing at least two interlaced images. The different images appear to an observer looking at the transparent lenticulated section from different angular perspectives. The lenticulated section is formed on a flat cover, and a base is provided which can releasably mate and snap together with the flat cover to provide a protective enclosure for the printed insert and to hold it in place with respect to, and in optical registration with, the lenticules of the lenticulated section. In a preferred embodiment of this display system, the base includes an articulated plate system that is moveable between several different positions to permit a user to configure the display system for use in several different display modes including a wall hanging mode, an easel mode, a badge mode, a pin mode for attachment to clothing, and a mode in which it can be attached to a metallic surface. The entire disclosure of this patent is herein incorporated by reference.

The display system described in this patent is very satisfactory for uses (for example, as a badge for permanent employees of a corporation) where the printed insert is rarely changed. However, this display system is less suitable for uses (for example, as a "recyclable" badge for persons attending exhibitions, conferences or similar gatherings, or as a device for viewing any one of a collection of printed inserts) where it is necessary to change printed inserts frequently. To change images in this display system, it is necessary to remove the base from the cover, overcoming the tight snap fit between the two, and in practice it is difficult to do this repeatedly without damaging the base, the cover or the articulated plate system attached to the base. Furthermore, in this display system, it is not possible to first fit the base and the cover together and then place a printed insert between them. Such "pre-assembly" of a display system, and later insertion of a printed insert, would be useful, for example, when the display system is used to provide temporary badges for attendees at a large gathering where many people have to be registered in a short time; in this situation, it is more convenient to pre-assemble a large number of display systems, and then insert the individual printed inserts into the pre-assembled displays as they are needed. Finally, the display system described in this patent requires manufacturing two separate pieces, which increases costs and may lead to problems in ensuring that all users have the same number of covers and bases.

It is an object of the present invention to provide a display/viewer which possesses most of the advantages of the display system described in Fantone but which permits insertion of a printed insert after the other parts of the display/viewer have been assembled.

It is a further object of the present invention to provide a display/viewer which can be formed in one piece.

It is a further object of the present invention to provide display/viewer in which the printed insert can be repeatedly changed without damage to the display/viewer.

Another object of the present invention is to provide optical arrangements and mechanical arrangements by which the viewable surfaces of flat display frames may be exploited to provide views of different information by observing those surfaces from slightly different perspectives in a variety of display modalities.

Yet another object of the present invention is to provide optical viewing arrangements for display frames that can be fabricated and assembled via high speed production machinery.

Still another object of the present invention is to provide optical display arrangements by which pseudo-dynamic information may be provided to an observer of a flat image display area.

Another object of the present invention is to provide an optical arrangement employing a lenticulated surface structured to compensate for parallax effects at customary viewing distances.

Still another object of the invention is to provide image displays that can easily be configured to fit a variety of image presentation needs.

Other objects of the invention will be apparent and will appear hereinafter in the following detailed description when read in connection with the drawings.

SUMMARY OF THE INVENTION

The inventive displays/viewers are an alternative to and improvement over other methods, such as standard picture frames (wood, plastic, metal), pins, buttons, badges, or cards (i.e., baseball cards, souvenirs, etc.).

Like the display system claimed in Fantone, the present display/viewer is intended for use with a printed insert bearing at least one pair of interlaced images, and comprises two major parts, a cover member, which has at least one transparent lenticulated section optically associated therewith, and a base. However, in the present display/viewer, the base has a plurality of flexible fingers extending in one direction therefrom. The cover member has a seating area for receiving the printed insert, and, adjacent this seating area, at least one abutment means against which a reference edge on the printed insert may be placed. The base and the cover member are pivotable relative to one another between an open position, in which the base does not overlie the seating area of the cover member, and a closed position in which the base does overlie the seating area and the flexible fingers of the base extend adjacent (and typically contact) the seating area. The base and the cover member are provided with complementary configured structure so that they snap fit together to retain themselves removably in their closed position. Crucially, the base and the cover member, when in their closed position, leave a slot between them though which the printed insert can be inserted into a display/viewing position, in which the flexible fingers urge the printed insert against the seating area with the interlaced images lying in the focal plane of the lenticules of the lenticulated section and in which the reference edge of the printed insert contacts the abutment means so as to rotationally align the interlaced images with the lenticules. Thus, when the display/viewer is in its closed position with the printed insert in its display/viewing position, the display/viewer provides different images to an observer looking at the transparent lenticulated section from different angular perspectives.

In the display/viewer of the present invention, the flexible fingers extend in one direction from the base, i.e., these fingers extend away from one side of the base. The fingers need not extend perpendicularly from the base and need not be exactly parallel to one another. Indeed, it is normally preferred that the fingers extend at an acute angle from the base so that, when the base and the cover member are in their closed position, the flexible fingers extend away from the slot, since such angularly-inclined fingers allow for smooth insertion of a printed insert through the slot into the display/viewing position.

As already noted, when the base and the cover member are in their closed position, the base overlies the seating area of the cover member with the flexible fingers extending adjacent the seating area. When no printed insert is present between the base and the cover member in this closed position, the fingers may or may not contact the cover member, depending upon the thickness of the printed insert which is to be used and the resiliency of the flexible fingers. The positioning and resiliency of the fingers should, however, be such that when a printed insert is inserted between the closed base and cover member, the fingers exert sufficient force upon the printed insert to hold it securely against the seating area so that the interlaced images on the printed insert are accurately aligned with the focal plane of the lenticules. The fingers should also exert sufficient pressure on the printed insert to prevent the insert falling out through the slot if the display/viewer is held with the slot downwards.

The base and the cover member of the present display/viewer may be formed as two separate parts provided with structure (for example, a pair of journals on one member and a pair of apertures on the other) which enable them to be fitted together while allowing the necessary pivoting relative to one another. However, for ease of manufacture and use, it is preferred that the base be integral with the cover member and connected thereto by means of a living hinge which permits the necessary pivoting. Desirably, such an integral base/cover member is formed of a material which permits repeated movement of the living hinge (for example, at least one hundred foldings and unfoldings of the hinge) to enable the base and cover member to be opened repeatedly to permit replacement of the printed insert. The material used must also, of course, be sufficiently transparent to enable the printed insert to be viewed through the lenticulated section of the cover member. Polystyrene, especially that sold commercially as "styrene K-resin" and containing rubberizing additives, has been found very suitable for this purpose.

The printed insert used in the present display/viewer may be of such a length that, when placed between the closed base and cover member, it does not extend through the slot, so that the base and cover member have to be opened to permit removal and replacement of the printed insert. However, in some cases, especially where, for example, the display/viewer is to be used as a viewer for any one of a multiplicity of printed inserts, it is desirable that the printed insert be so dimensioned that, when the base and the cover are in their closed position with the reference edge of the printed inserted abutting the abutment means, a portion of the printed insert extends through the slot; this protruding portion of the printed insert can act as a handle which can be grasped to permit removal of the printed insert without opening of the display/viewer. Where such printed inserts are expected to be repeatedly removed from and replaced within the display/viewer, in order to prevent wear or damage to the protruding portion of the printed insert, the protruding portion may be provided with a handle means (for example, a clip of substantially C-shaped cross-section which clips on to the protruding portion) which can be grasped to remove the printed insert from, or replace it within, the display/viewer.

Depending upon its intended use, the base of the display/viewer may be provided with an attachment or support means in the form of a clip, pin, magnet, articulated stand or one or more recesses to permit attachment to, or resting upon, a support structure. Such an attachment or support means may be a separate part affixed to the base, but desirably is integral with the base; thus, the cover member, base and attachment or support means can desirably form a single part. For example, the base may comprise a support section which, when the base and the cover member are in their closed position, can be used to support the display/viewer upon a flat surface. Such a support section is desirably integral with the base and connected thereto by means of a living hinge which permits pivoting of the base and the support section relative to one another. In a preferred embodiment of the display/viewer, as illustrated in FIG. 9 below, the support structure is of the type described in Fantone and is moveable between several different positions to permit a user to configure the display/viewer for use in several different display modes including a wall hanging mode, an easel mode, a badge mode, a pin mode for attachment to clothing, and a mode in which it can be attached to a metallic surface.

In preferred embodiments of the present display/viewer, the spatial frequency of the lenticulated panels and interlaced images are arranged with respect to one another to compensate for parallax effects which would otherwise be present when the flat panels are observed at customary viewing distances. Preferably, the spatial frequency of the interlaced images are adopted as fixed and the spatial frequency of the lenticules is made higher by a factor approximately in the ratio of the of the viewing distances to their respective planes, adjusted for refraction effects due to lenticule thickness, material composition, and viewing distance, as needed.

BRIEF DESCRIPTION OF THE DRAWINGS

The structure and operation of the display/viewer of the present invention, together with other objects and advantages thereof, may best be understood by reading the detailed description in connection with the drawings in which unique reference numerals have been used throughout for each part and wherein.

DETAILED DESCRIPTION OF THE INVENTION

Figure 1:
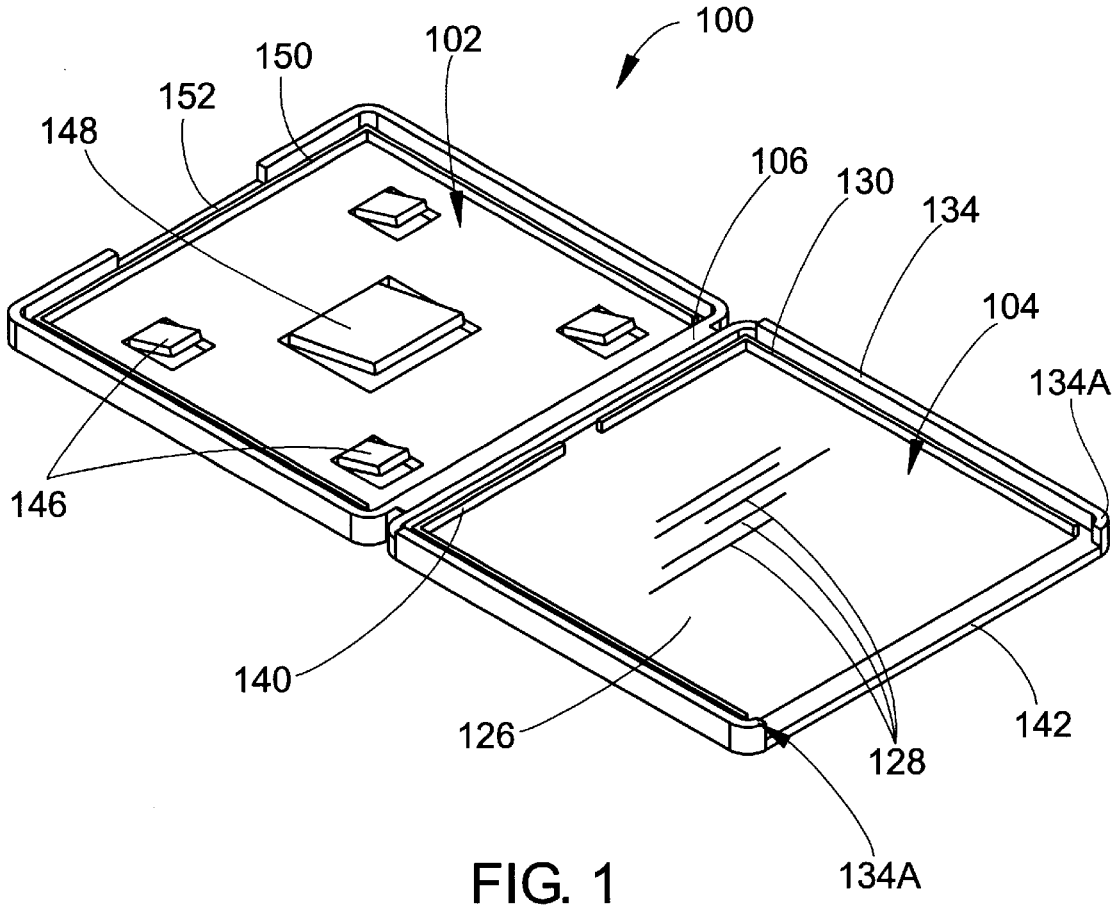
FIG. 1 is a three-quarter view, from above and to one side, of a first display/viewer of the present invention with the base and cover member in their open position.
Figure 2:
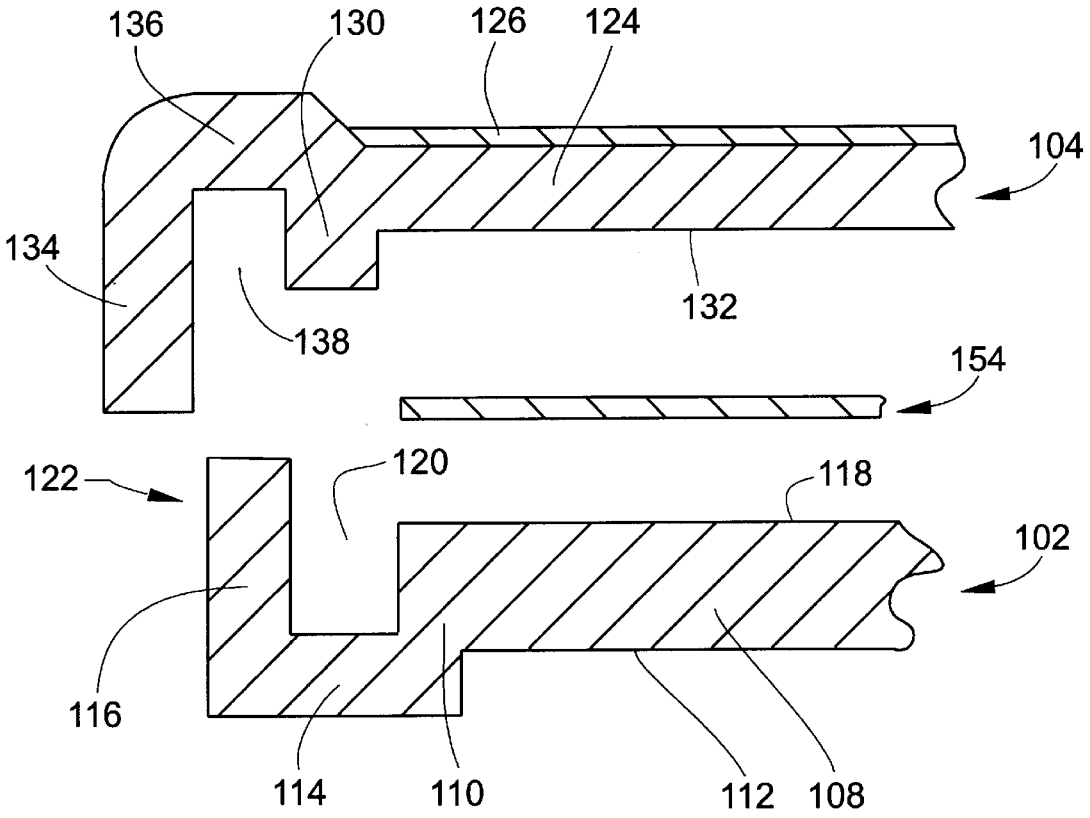
FIG. 2 is an enlarged, exploded section through part of the base, cover member and associated printed insert of the display/viewer shown in FIG. 1 taken generally along line II—II in FIG. 5.

The first display/viewer of the present invention (generally designated 100) shown in FIGS. 1 and 2 comprises a base 102 and a cover member 104, each of which is essentially square. The base 102 and the cover member 104 are preferably pivotally connected to each other by a living hinge 106 which extends substantially the full length of the adjacent edges of base 102 and cover member 104. The hinge 106 permits the base 102 to pivot substantially 180° from the open position shown in FIG. 1, in which the base 102 does not overlie any portion of the cover member 104, to a closed position (shown in FIGS. 4 and 5) in which the base 102 does overlie the cover member 104. Since the upper surfaces (as shown in FIG. 1) of the base and cover member closely approach each other when the base and cover member are in their closed position, for convenience these surfaces will hereinafter be called the "inner" surfaces of the base and cover member, while the opposed surfaces will hereinafter be called the "outer" surfaces.

Since the cross-sections of the base 102 and the cover member 104, and especially of the peripheral portions of these members aid in the functioning of the display/viewer, these cross-sections will now be described with reference to FIG. 2, which shows a cross-section through an enlarged, exploded cross-section through a peripheral portion of the display/viewer shown in FIG. 1 along the line II—II in FIG. 5, with the base and cover member in their closed position and with a printed insert 154 lying therebetween. As shown in FIG. 2, the base 102 comprises a flat central plate 108 surrounded by a flange 110 which extends outwardly from the outer surface 112 (the lower surface in FIG. 2) of the base. The flange 110 carries a horizontal flange 114, the outer edge of which carries a flange 116 which extends upwardly (in FIG. 2) beyond the inner surface 118 of the base 102, the flanges 110, 114 and 116 together defining a groove 120 surrounding the flat central plate 108 and forming a bezel (generally designated 122) which strengthens and stiffens the periphery of the base 102.

Cover member 104 has a flat central plate 124, on the outer surface of which is formed a lenticulated section 126. As shown in FIG. 1, in the first display/viewer shown in that Figure, the individual lenticules 128 of the lenticulated section 126 run parallel to the living hinge 106, although other orientations are possible, as described in more detail below. While lenticules 128 are shown enlarged, it will be appreciated that in practice they are small, having spatial frequencies ranging between, for example, 1 to 10 lenticules per millimeter. Around the periphery of the flat central plate 124 runs a flange 130 which extends perpendicularly from the inner surface 132 of cover member 104. An outer flange 134 runs parallel to and outside flange 130, extending a greater distance perpendicularly from the inner surface 132 of cover member 104 towards base 102, the outer flange 134 being connected to the periphery of the flat central plate 124 by a connecting member 136, which extends outwardly beyond the lenticulated section 126 and thus forms a bezel surrounding this lenticulated section. A groove 138 is left between flanges 130 and 134, and this groove 138 is arranged to receive flange 116 on the base 102, thereby helping to hold the base adjacent the cover member when these two members are in their closed position.

As already mentioned, FIG. 2 shows a cross-section through peripheral portions of a side edge of base 102 and cover member 104. Along the edge of the cover member 104 adjacent the living hinge 106, the flange 130 is continued as an abutment flange 140 (FIG. 1), but the outer flange 134 is truncated so that it does not extend inwardly beyond the end of abutment flange 140. Along the opposed edge 142 (FIG. 1) of cover member 104 the flange 130 is completely omitted, and most of outer flange 134 is also omitted, leaving only small portions 134A adjacent the corners of the cover member 104. The connecting member 136 remains, so that along this edge 142 nothing projects beyond the inner surface of cover member 104. Thus, when the base 102 is rotated to its closed position, a slot 144 (see FIG. 4) is left between the edge 142 of cover member 104 and the adjacent edge of the base 102.

Figure 4:
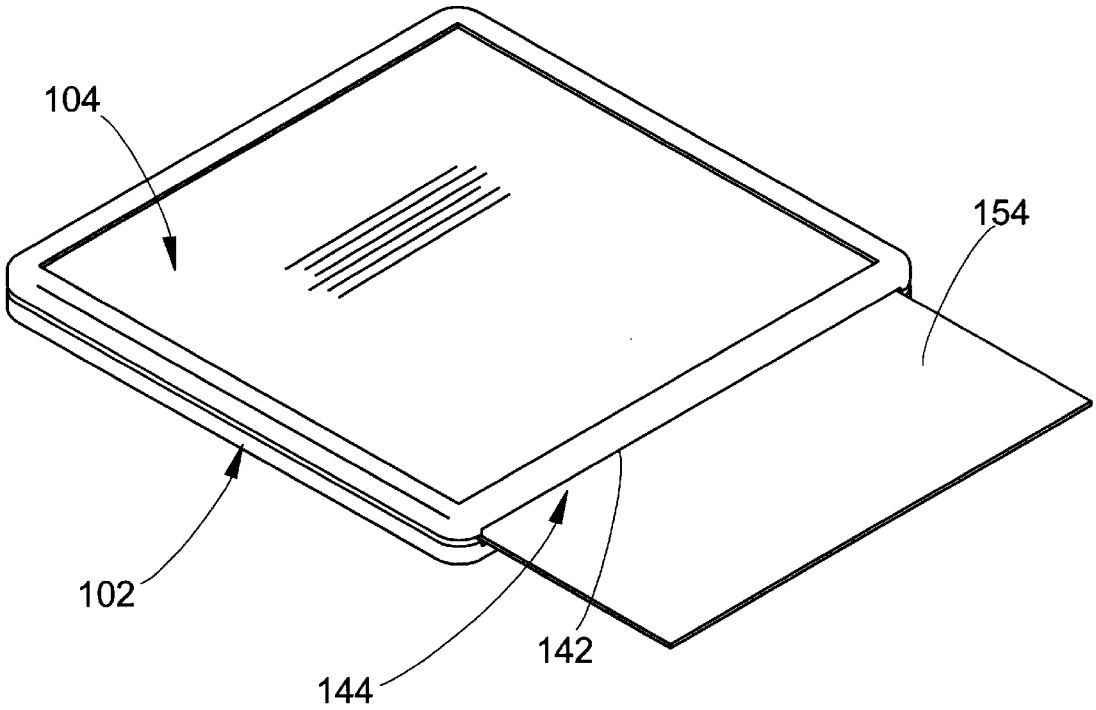
FIG. 4 is a three-quarter view, generally similar to that of FIG. 3 but with the base and the cover member in their closed position and with the printed insert being inserted through a slot between the base and the cover member.

Base 102 is provided with four small flexible fingers 146, one disposed adjacent each corner of the base, and a single larger, centrally located flexible finger 148. The fingers 146, 148 extend away from the inner surface 118 (FIG. 2) of base 102 at an angle of approximately 30° to that surface, being directed towards the hinge 106 so that, when the base 102 is rotated to its closed position, the fingers 146, 148 extend away from the slot 144 (FIG. 4). This inclination of the fingers 146, 148 away from the slot facilitates insertion of a printed insert through the slot between base 102 and cover member 104, and helps to prevent accidental removal of the printed insert. As shown in FIG. 1, fingers 146, 148 may be produced by cutting around three sides of rectangles in the central plate 108 of base 102, and deforming the resultant "tongues" upwardly away from the remainder of plate 102.

The base 102 is dimensioned so that, when the base is rotated from the open position shown in FIG. 1 to the closed position shown in FIG. 4., the edge 150 of base 102 remote from hinge 106 snaps fits within portions 134A of outer flange 134 on the cover member 104. This snap fit of base 102 within portions 134A of outer flange 134, together with the aforementioned reception of flange 116 on base 102 within groove 138 on cover member 104 ensures that base 102 and cover member 104, once placed in their closed position, retain themselves removably in this position. As indicated at 152 in FIG. 1, a portion of flange 116 is omitted along a central portion of edge 150 of base 102; this omission of flange 116 at 152 assists in manual opening of the display/viewer 100, as described below.

The manner in which a printed insert (generally designated 154) is inserted into the display/viewer 100 and retained therein in proper alignment with lenticulated section 126 will now be described with reference to FIGS. 2, 3 and 4. It will be appreciated that in practice insertion of printed insert 154 is carried out with display/viewer 100 in its closed position, as shown in FIG. 4; however, certain features of display/viewer 100 are more easily appreciated from the view of FIG. 3, which shows the insertion of printed insert 154 into a "semi-open" display/viewer 100.

The flat central plate 124 of cover member 104 serves as a seating area for receiving printed insert 154 and holding the printed insert with the interlaced images thereon lying in the focal plane of the lenticules 128 (FIG. 1) of lenticulated section 126; the lenticules 128 are formed so that they have a common focal planes lying immediately adjacent inner surface 132 (FIG. 2) of cover member 104. Also, the abutment flange 140, which lies adjacent the edge of central 124 closest to hinge 106 acts as an abutment means against which a reference edge 156 (FIG. 3) of printed insert 154 can rest with the interlaced images on printed insert 154 in proper rotational alignment with lenticules 128. Finally, flanges 130 along the side edges of cover member 102 act as guides for printed insert 154 during insertion and removal of this printed insert, and also serve to ensure proper rotational alignment of insert 154 with lenticules 128; as will been seen from FIGS. 2 and 3, printed insert 154 has a width which fits snugly between flanges 130 along the side edges of cover member 102.

Figure 3:
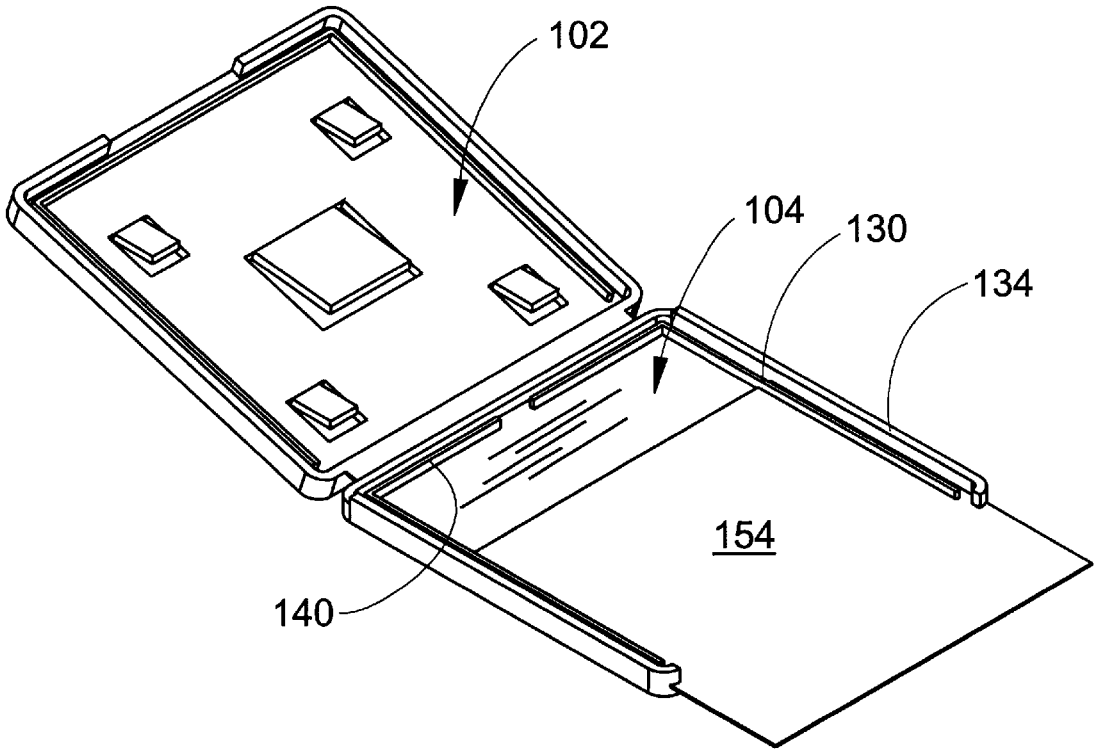
FIG. 3 is a three-quarter view, from above and to one side, of the display/viewer shown in FIG. 1 of the present invention with the base and cover member in a slightly different open position, and illustrates the manner in which the printed insert shown in FIG. 2 is guided by the cover member into its display/viewing position.

Accordingly, as illustrated in FIGS. 3 and 4, when display/viewer 100 is in its closed position, printed insert 154 can be inserted through slot 144 between the edge 142 of cover member 104 and the adjacent edge of the base 102 and will be guided by flanges 130 until its leading edge abuts flange 140 adjacent hinge 106. Printed insert 154 slides smoothly beneath fingers 146, 148 because of the inclination of these fingers away from slot 144, but once the leading edge of printed insert 154 abuts flange 140, the flexible fingers 146, 148 hold printed insert 154 flat against central plate 124 of cover member 104, thus ensuring proper placement of the interlaced images on printed insert 154 with the focal plane of lenticules 128, while the abutment of the leading edge of printed insert 154 with the flange 140 ensures that the interlaced images are in proper rotational alignment with the lenticules, so that an observer viewing the lenticulated section 126 from differing angles sees differing optical effects.

The preferred method for removing printed insert 154 from display/viewer 100 depends upon the dimensions of the insert. If printed insert 154 is of such a length that when its leading edge abuts flange 140, the insert fits completely display/viewer 100 with no portion of the insert extending through slot 144, it is necessary to open display/viewer 100 to remove printed insert 154. To do so, the user simply grasps edge 150 of base 102 and the adjacent edge of cover member 104, and pulls them apart against the resistance of the snap fit therebetween. Alternatively, the user may insert a fingernail, pencil, letter opener or other narrow object at 152 (note that this insertion can be made "behind" printed insert 154, on the opposed side thereof from the interlaced images, thus reducing the risk of damage to the images) and lever or wedge base 102 and cover member 104 apart.

If, however, printed insert 154 is of such a length that when its leading edge abuts flange 140, and a portion of the insert extends through slot 144, the user simply grasps the protruding portion of the insert and pulls it firmly out of the closed display/viewer 100. Because of the inclination of flexible fingers 146, 148, the force required to effect such removal of printed insert 154 is somewhat greater than the force required for its insertion, but in practice the removal can readily be effected without damage to the images on the insert, and without any risk of damage to the display/viewer. As already indicated, a clip or other handle means may be provided on the protruding portion of printed insert 154 to facilitate removal of the insert and/or reduce the risk of damage thereto.

It must be kept in mind that the images on the printed insert 154 must be aligned within acceptable visual tolerances with respect to the loci of focal lines of the lenticular surfaces, i.e., the insert must be flat over the area of visual interest, and must not be twisted, or tilted, with respect to the longitudinal axes of the lenticules. More particularly, the printed inserts must be flat within allowable tolerances on depth of field.

For a circle of confusion of about 0.005" (0.13 mm—visual acuity) and for a plastic cover member with a typical refractive index, this depth of focus is about plus or minus 0.008 inches (0.2 mm).

As already noted, the printed insert 154 must be accurately aligned with (i.e., parallel to) the longitudinal axes of the lenticules to within limits or adverse visual effects can occur in the form of ripples that become apparent across the face of the viewed field. What has been found preferable is to keep the interlaced images parallel to the longitudinal axes of the lenticules to within 2 or less times the width of a single segment of an interlaced image resident behind a lenticule over the length of the images of interest. Consequently, if the images are long, this tolerance is more demanding than if short. However, what is interesting is that the images can slide perpendicular to the lenticules without objectionable visual problems; one just sees the different views in different orders. Even so, the tilt must remain within the above limits to avoid rippling. This means that the edges of the printed inserts must be straight to within this tolerance.

Figure 5:
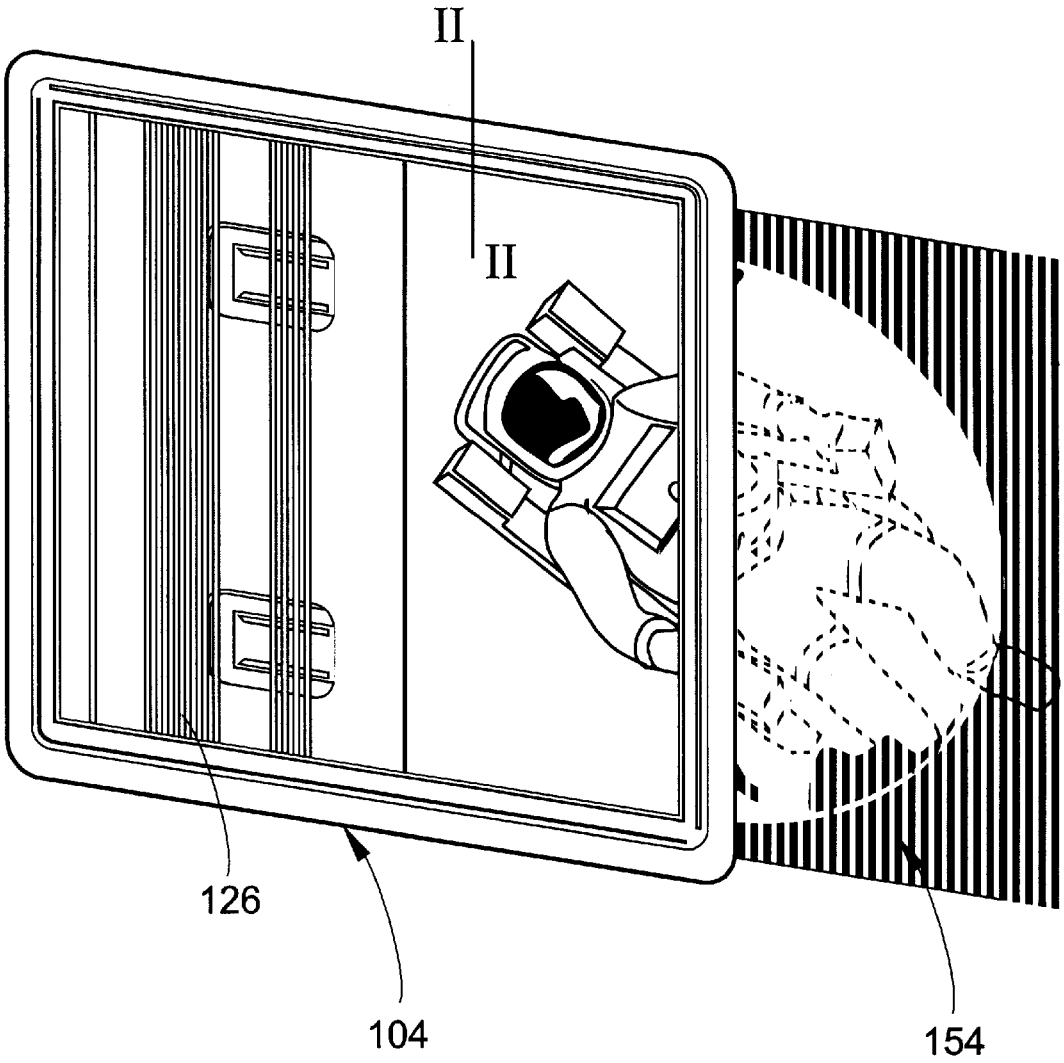
FIG. 5 is a view generally similar to that of FIG. 4, but taken from the opposed side of the display/viewer, and illustrates how the appearance of the printed insert changes when seen through the lenticulated section of the cover member.
Figure 6:
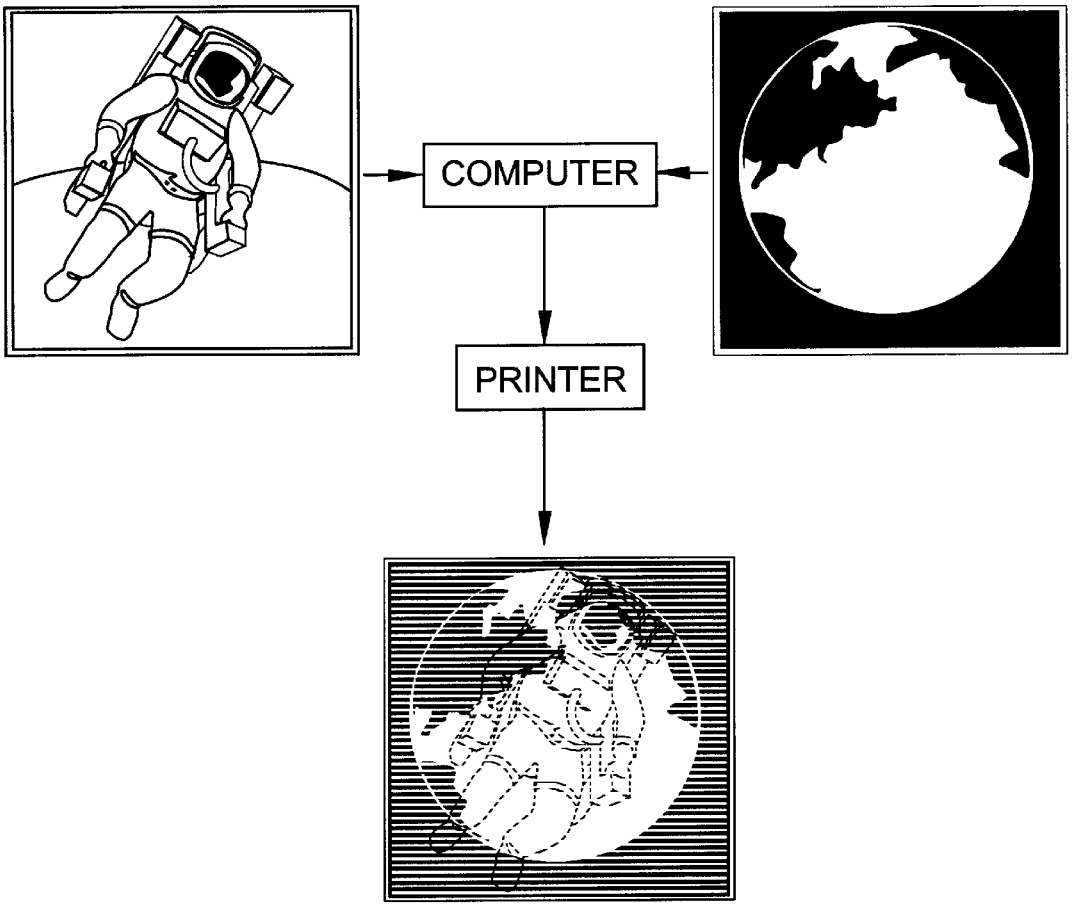
FIG. 6 shows how two separate images are combined to produce the image on the printed insert shown in FIG. 5.

FIGS. 5 and 6 illustrate optical effects which can be achieved by display/viewer 100. FIG. 6 illustrates how a first (astronaut) image shown in the upper left corner of FIG. 6 may be combined (preferably by one of the methods described in the aforementioned U.S. patent applications Ser. Nos. 08/990,688 and 60/074,384, now U.S. application Ser. No. 09/211,510) with a second (earth) image shown in the upper right corner to form a pair of interlaced images on printed insert 154, as shown in the lower part of FIG. 6. It will be seen that the interlaced images on printed insert 154 are not readily decipherable by the human eye. However, when printed insert 154 is inserted into display/viewer 100, as shown in FIG. 5, the lenticulated section 126 readily reconstructs the individual images and an observer viewing lenticulated section 126 from an given angular position sees only one image, the astronaut image in the case of FIG. 5.

Figure 7:
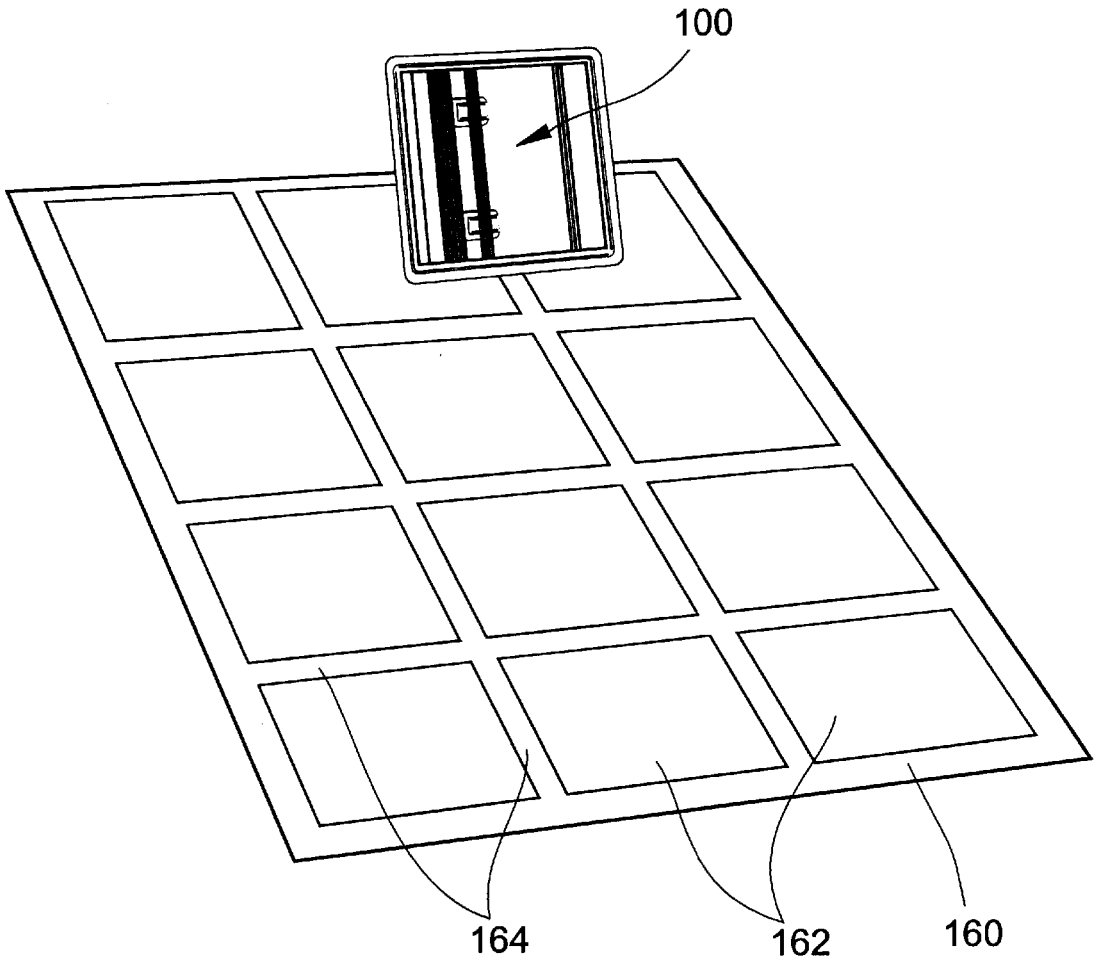
FIG. 7 shows the display/viewer shown in FIGS. 1–5 in its closed position and lying adjacent a sheet adapted for use in preparing printed inserts such as that shown in FIGS. 5 and 6.
Figure 8:
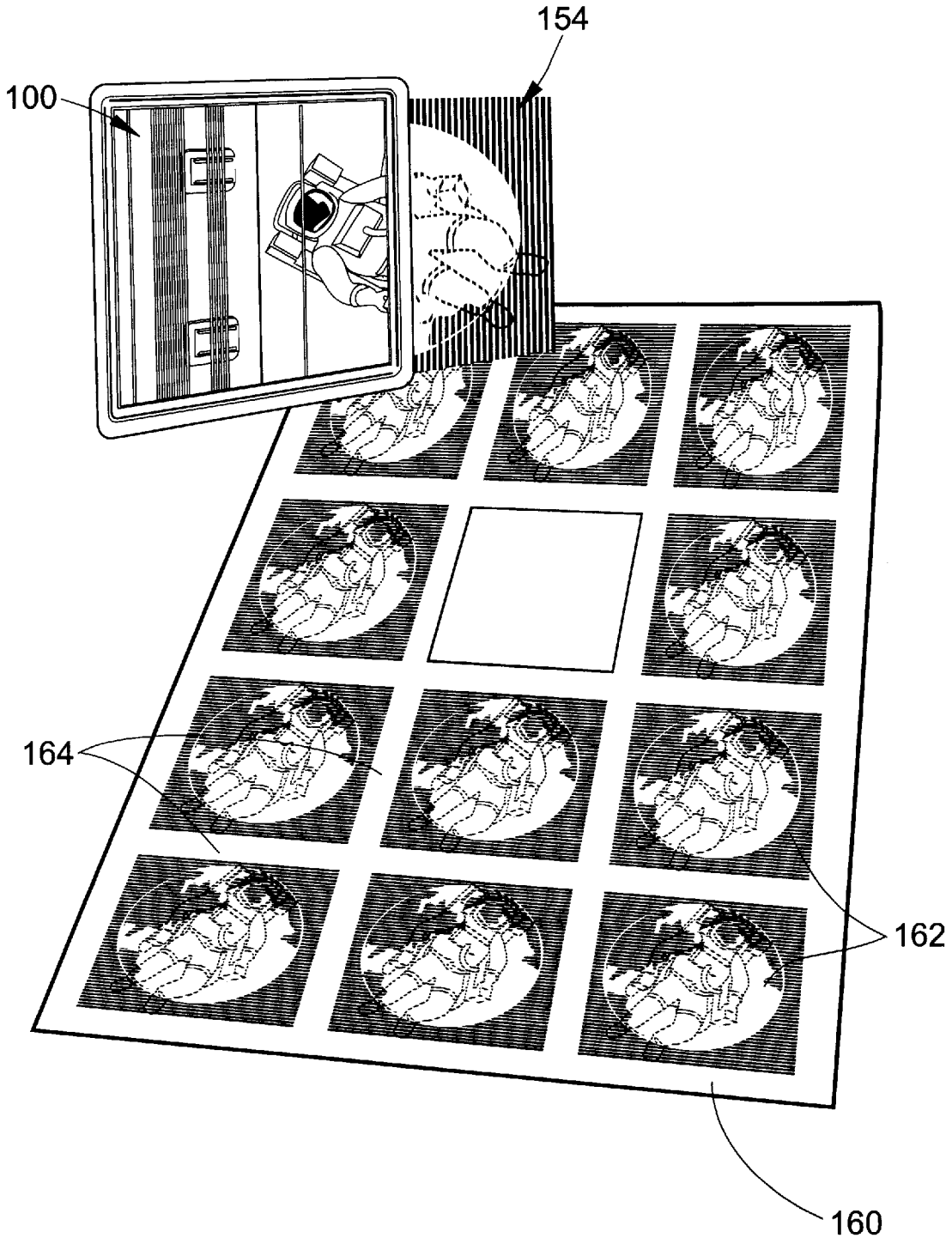
FIG. 8 shows the sheet shown in FIG. 7 printed with a plurality of images to form a plurality of printed inserts of the type shown in FIGS. 5 and 6, with a single one of these printed inserts being detached from the sheet and inserted with the display/viewer in the manner shown in FIGS. 4 and 5.

FIGS. 7 and 8 illustrate a preferred method for production of printed insert 154. As shown in FIG. 7, this method uses a sheet 160 of material appropriate for printing by the particular technique (for example, ink jet printing) to be used to prepare the insert. Before printing the sheet 160 is rouletted to form an array of panes 162 (a 3×4 array is shown in FIG. 7) separated by gutters 164. The sheet is then printed with a copy of the desired interlaced images in each of the panes 162; the production and proper placement of the necessary multiple images is readily achieved by computer software, as described in the aforementioned U.S. patent applications Ser. Nos. 08/990,688 and 60/074,384, now U.S. application Ser. No. 09/211,510. Individual panes 162 can then be manually or mechanically separated at the roulette lines to form individual printed inserts ready for insertion into display/viewer 100, as illustrated in FIG. 8.

Figure 9:
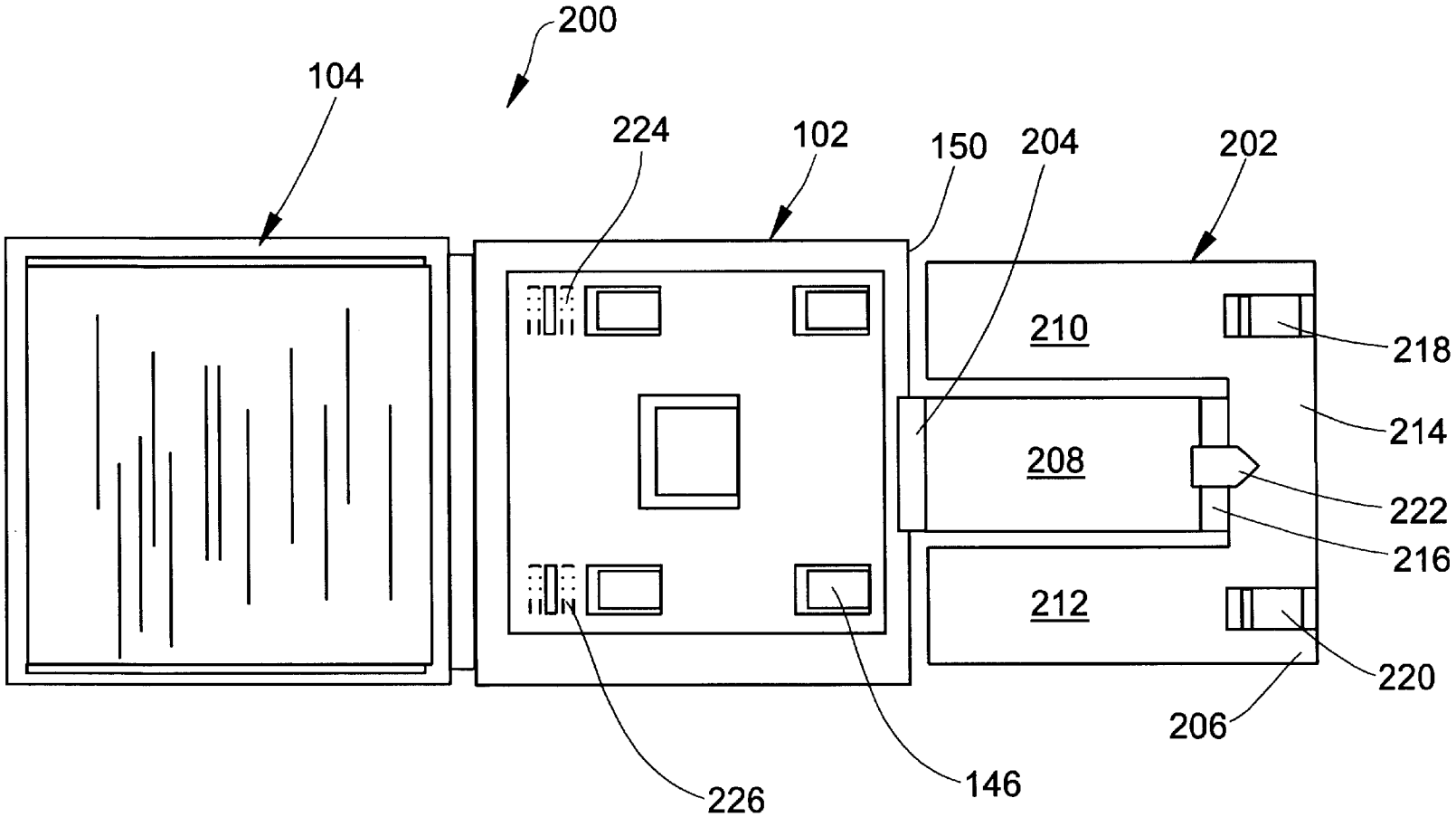
FIG. 9 is a top plan view of a second display/viewer of the present invention provided with a multi-purpose support section, with the base and the cover section in their open position.

FIG. 9 shows a second display/viewer (generally designated 200) of the present invention having a base 102 and cover member 104 essentially identical to those of the first display/viewer 100 already described. However, display/viewer 200 also comprises an articulated plate section 202 connected via a living hinge 204 to the edge 150 of the base 102 remote from the cover member 104. Articulated plate section 202 is of the type described in Fantone and allows display/viewer 200 to assume a variety of display modes for different display and/or viewer environments. Articulated plate system 202 comprises a "U"-shaped plate 206 and a rectangular plate 208. The "U"-shaped plate 206 includes vertically extending posts, 210 and 212, that are connected by a horizontally extending cross piece 214. Rectangular plate 208 is connected to one edge of cross piece 214 via a living hinge 216 and to edge 150 of base 102 via the living hinge 204 to permit plates 206 and 208 to be pivoted with respect to one another and with respect to base 102.

Cross piece 214 has three apertures holes, 218, 220, and 222 formed therein, with aperture 222 only extending across hinge 216 into rectangular plate 208. Apertures 218 and 220 provide openings through which clips 224 and 226 respectively, can fit. The clips 224 and 226 are formed on the outer surface 112 of base 102 and hence are shown in broken lines in FIG. 9; provision of these clips 224 and 226 may require minor changes in the position of two of the fingers 146, but such minor repositioning of these fingers 146 involves no essential change in the finctioning of base 102.

Aperture 222 provides a means by which display/viewer 200 may be hanged by means of nails, hooks or the like, from vertical surfaces such as walls. Clips 224 and 226 each comprise spaced apart, flexible fingers that are dimensioned so that, when the clips are inserted in apertures 218 and 220, the engagement between the clips and the apertures will hold articulated plate section 202 flat against base 102, in a manner similar to that illustrated in FIG. 6 of Fantone.

If one now pulls the articulated plate section 202 away from base 102 and inserts the edge of cross piece 218 remote from hinge 216 into clips 224 and 226, and places base 102 and cover member 104 in their closed position, display/viewer 200 is now placed in an easel mode, in which plate section 202 extends essentially perpendicular to base 102 so that display/viewer 200 can rest upon a horizontal surface for display purposes (cf. FIG. 7 of Fantone). This reconfiguration of the articulated plate arrangement is quite easily achieved because of the living hinges provided.

Once the articulated plate section 202 is disengaged from the outer surface of base 102, a pin or alligator clip may be slid behind rectangular plate 208 and plate section 202 re-engaged with the outer surface of base 102 to provide display/viewer 200 with the capability to be "pinned" or "clipped" to a wearer's clothing to act as a badge, such as for identification purposes.

If articulated plate section 202 is left in the position shown in FIG. 9, in which it is only attached to base 102 by living hinge 204, but base 102 and cover member 104 are placed in their closed position, posts 210 and 212 may be placed into a shirt pocket or the like to enable display/viewer 200 to serve as a badge, personal or commercial message display; cf. FIG. 8 of Fantone.

Displays/viewers 100 and 200 may also be provided with a magnet to enable the displays/viewers to be displayed on a metallic surface. For example a magnet could be placed on the outer surface 112 of base 102, or on rectangular plate 208, via suitable adhesives or other fastening means.

It will be seen that the displays/viewers 100 and 200 can each be molded in a single piece from plastic by injection molding or similar techniques; forming the displays/viewers as a single part in this manner keeps the cost low. The displays/viewers are preferably molded of a transparent, durable plastic such as polystyrene, especially the aforementioned "styrene K" resin. Although the plastic used must of course be sufficiently transparent to allow proper viewing of the printed insert through the lenticulated section of the cover member, if desired a colored plastic may be used, for example to create special color effects for instance when the display/viewer is intended to be used as a novelty or souvenir item.

While the displays/viewers 100 and 200 have been described above assuming only two separate views are present on the printed insert, it will be appreciated that more than two views are quite feasible, depending on the number of interlaced images provided. It should also be appreciated that such views can periodically repeat themselves as the angle of view over the surface of the lenticulated surface changes.

Furthermore, although display/viewer 100 has been illustrated in FIG. 6 with a printed insert 154 in which two essentially unrelated images are interlaced, it will be appreciated that the two interlaced images could be images of the same object from different angles, so that an observer seeing the two images through the lenticulated section would see a three-dimensional image. Alternatively, the interlaced images could be a series of images of an object in motion, so that, as the observer moves relative to the lenticulated section, an animated effect is produced.

Similarly, although the displays/viewers 100 and 200 have been illustrated with horizontal lenticules 128, the lenticules could be vertically oriented or at any desired angle. Multiple lenticulated sections having lenticules arranged at various different angles may also be provided, with a corresponding plurality of pairs of interlaced images on the associated printed inserts. It should also be understood that it is not necessary to form the lenticulated section(s) as unitary structures integral with the cover member (as in the displays/viewers 100 and 200) since it is within the teaching of the invention to attach separately formed lenticulated wall sections to otherwise smooth cover members by using suitable adhesives or other means of attachment.

Figure 10:
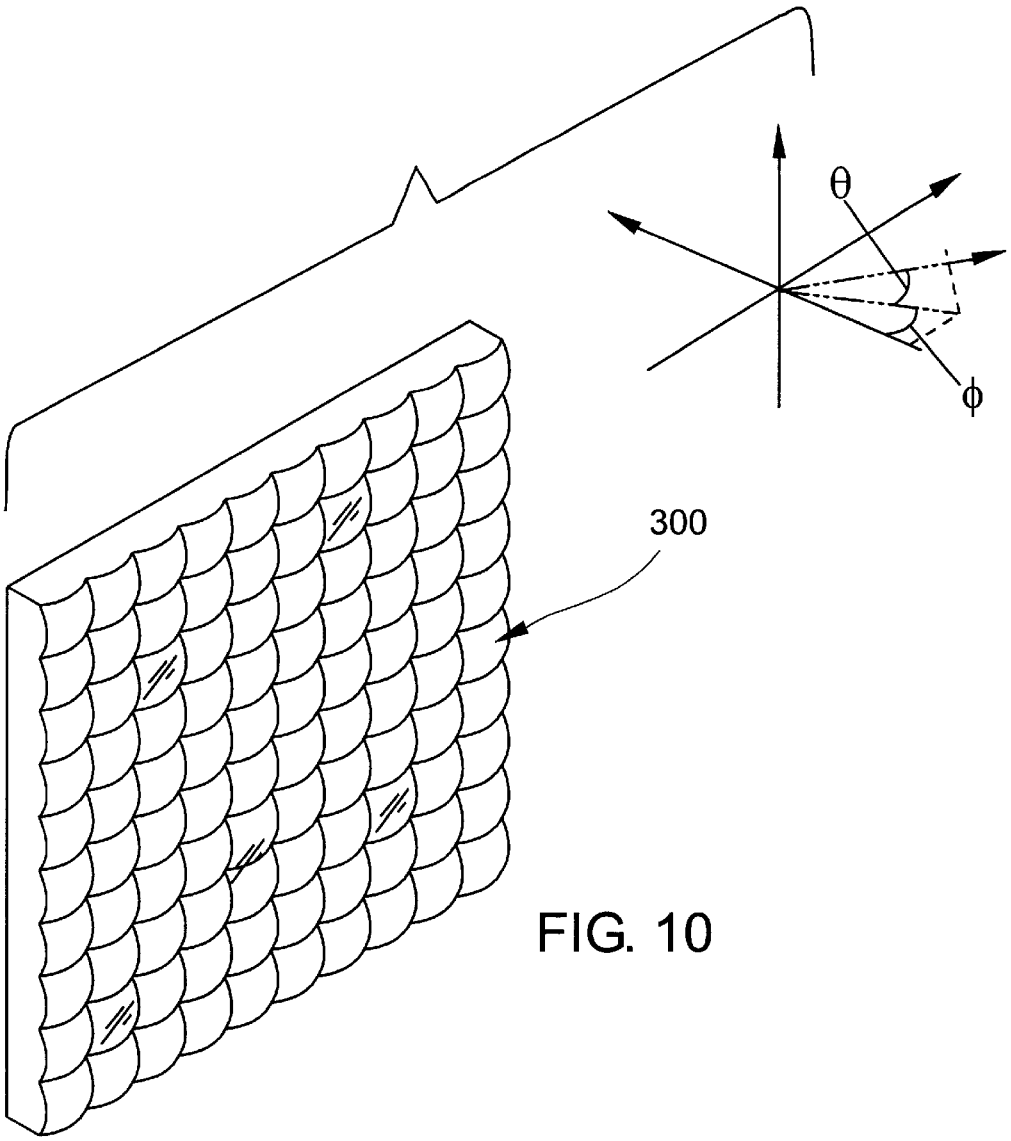
FIG. 10 is a diagrammatic perspective view of a two dimensional optical system which may be used as the lenticulated section of the present display/viewer.
Figure 11:
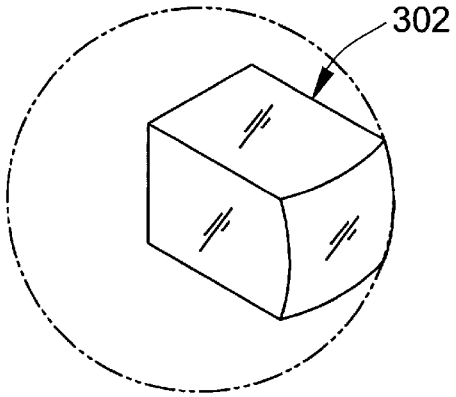
FIG. 11 is a diagrammatic perspective view of a single lens element of the optical system shown in FIG. 10.

Indeed, the lenticules used in the present displays/viewers need not be of the essentially hemicylindrical form shown in the drawings. As shown in FIGS. 10 and 11 and as more particularly described in copending commonly owned U.S. Pat. No. 5,769,227 (issued Jun. 23, 1998 on application Ser. No. 08/772,968 filed Dec. 23, 1996), the contents of which are hereby incorporated by reference, the lenticulated section of the inventive displays/viewers may also be comprised of two dimensional arrays of lenslets as designated generally at 300. An individual lenslet 302 having a generally rectangular shape is shown in FIG. 11. However, it will be realized that other suitable geometric shapes would be suitable to achieve desired optical effects.

Also, although displays/viewers 100 and 200 have been illustrated with square lenticulated sections and interlaced images, it will be understood that other shapes may be used for the images. For example, rectangles or other polygonal shapes or other geometries with a finite number of axes of symmetry would be suitable.

It is shown in Fantone (see columns 8–9 and FIGS. 11–15 thereof), that if the spacing of the lenticules in made exactly equal to that of the strips of the interlaced images, a parallax or "walk-off" problem exists whereby the line of sight of a viewer seeing the lenticulated section at an angle to the normal begins to walk away from the proper image segment as the viewing angle increases until the proper image segment is missed altogether. Fantone also shows a preferred way of correcting this problem by increasing the spatial frequency of the lenticules. Alternatively, spatial frequency of the strips of interlaced images may also be adjusted or both can be altered to address the problem. However, it is somewhat easier to build the correction into the molding tool and use available printing techniques to achieve the spatial frequency of the interlaced images. The same techniques are desirably used to avoid the problem in the displays/viewers of the present invention.

Fantone also describes various types of folded printed insert. Although typically, because of the presence of the flexible fingers on the base which hold the printed insert against the seating area of the cover member, a printed insert having only the thickness of a printed sheet (such as the printed inserts shown in FIGS. 7 and 8) performs satisfactorily in the present display/viewer, thicker inserts, including folded inserts as shown in Fantone, may be useful in some cases.

Those skilled in the art may make other changes to the invention without departing from the scope of its teachings. Therefore, it is intended that the embodiments described herein be considered as illustrative and not be construed in a limiting sense.

What is claimed is:

1. A display and viewing unit, for use with a printed insert bearing at least one pair of interlaced images and having a reference edge, said unit comprising:

a base having resilient biasing means extending in one direction therefrom; and a cover member having at least one transparent lenticulated section optically associated therewith, said cover member having a seating area for receiving said printed insert, said cover member also having, adjacent said seating area, at least one abutment means against which said reference edge of said printed insert may be placed, said base and said cover member being pivotable relative to one another between an open position, in which said base does not overlie said seating area of said cover member, and a closed position in which said base overlies said seating area with said resilient means of said base extending adjacent said seating area, said base and said cover member being provided with complementary configured structure whereby said base and said cover member fit together to retain themselves removably in their closed position, said base and said cover member, when in their closed position, defining a slot therebetween through which said printed insert can be inserted to a display/viewing position in which said resilient means urge said printed insert against said seating area with said interlaced images lying in the focal plane of the lenticules of said lenticulated section, and in which said reference edge of said printed insert contacts said abutment means so as to rotationally align said interlaced images with said lenticules.

2. A unit according to claim 1 wherein said base is integral with said cover member and is connected thereto by means of a living hinge which permits said pivoting of said base and said cover member relative to each other.

3. A unit according to claim 1 wherein said resilient means comprises a plurality of flexible fingers and wherein, when said base and said cover member are in their closed position, said flexible fingers extend away from said slot.

4. A unit according to claim 1 wherein said base further comprises a support section which, when said base and said cover member are in their closed position, can be used to support the display/viewer upon a flat surface.

5. A unit according to claim 4 wherein said support section is integral with said base and is connected thereto by means of a living hinge which permits said pivoting of said base and said support section relative to each other.

6. A unit according to claim 1 in combination with said printed insert, said printed insert being so dimensioned that, when said base and said cover member are in their closed position with the reference edge of said printed insert abutting said abutment means, a portion of said printed insert extends through said slot.

7. A unit according to claim 1 wherein said base and said cover member are cooperating members configured and arranged with respect to one another to snap-fit together.

* * * * *